United States Patent [19]

Morton et al.

[11] 4,225,058

[45] Sep. 30, 1980

[54] NOZZLE CAP HAVING OPENING MEANS

[75] Inventors: Reginald F. Morton, Leicester; Sidney Glover, Worsley, both of England

[73] Assignee: USM Corporation, Farmington, Conn.

[21] Appl. No.: 42,435

[22] Filed: May 25, 1979

[30] Foreign Application Priority Data

May 30, 1978 [GB] United Kingdom ..... 24189/78

[51] Int. Cl.[3] ..... B67B 7/24

[52] U.S. Cl. ..... 222/81; 222/541; 220/278

[58] Field of Search ..... 220/227, 278; 222/81, 222/541

[56] References Cited

U.S. PATENT DOCUMENTS

| | | | |
|---|---|---|---|
| 2,671,577 | 3/1954 | Remington | 222/81 X |
| 3,339,812 | 9/1967 | Meissner | 220/278 X |
| 4,146,152 | 3/1979 | Ogawa et al. | 222/81 |

*Primary Examiner*—George T. Hall

*Attorney, Agent, or Firm*—John P. Morley; Richard B. Megley; Vincent A. White

[57] ABSTRACT

This invention presents to the art a novel, improved plastic nozzle cap for a compressible tube having a sealed outlet opening. The novel, improved nozzle cap comprises an outlet bore and means for securing the cap to the tube. The outlet bore is positioned in a predetermined relationship with the outlet opening of the tube to which the cap is to be secured so that when the cap is secured to the tube, a device can be inserted into the outlet bore to pierce the sealed outlet opening of the tube. The device used to pierce the sealed outlet is an integral part of the cap but can be readily broken from the cap. The broken off device has a portion dimensioned and shaped so that the device has the capability for piercing the sealed outlet opening of the tube and for closing the outlet bore.

4 Claims, 3 Drawing Figures

NOZZLE CAP HAVING OPENING MEANS

THE FIELD OF THE INVENTION

This invention relates to improved nozzle caps for compressible tubular dispensers such as compressible adhesive tube dispensers.

DESCRIPTION OF THE PRIOR ART

The practice of packaging viscous solvent-based adhesive compositions in compressible tubes is well known. Such tubes have a neck end which provides an outlet for the contents of the tube. The outlet is sealed when the tube is purchased usually by an integral metal web closure to keep the adhesive composition in a usable condition. United Kingdom Pat. No. 1,014,994 discloses a plastic nozzle cap for use with a compressible tube. The cap comprises an outlet bore for the material in the tube to which the cap is attached and a second bore in the cap which forms a pocket for an eyescrew which is detachably retained in the pocket when the tube is purchased. As disclosed in the Patent, the eyescrew may be used to pierce the metal web closure and to close the outlet bore in the cap so that unused adhesive composition can be maintained in a usable condition after piercing the metal web closure.

A nozzle cap similar to that described in the Patent mentioned above has been marketed successfully with tubes of adhesive composition for many years. However, the cost of providing and assembling two separate components, namely the plastic cap and the eyescrew has become increasingly undesirable.

SUMMARY OF THE INVENTION

A principal object of the present invention is to provide a novel, improved plastic nozzle cap for compressible tubes at lower costs. Essentially, the novel improved plastic nozzle cap is designed for attachment to a compressible tube having a sealed outlet opening. The plastic nozzle cap comprises an outlet bore in the cap for the material in a tube and means for securing the cap to the compressible tube. Additionally, the outlet bore is positioned so that a device inserted into the outlet can pierce the sealed outlet of the tube. In accordance with the present invention the device for piercing the tube's sealed outlet is integrally formed with the cap but can be readily broken from the cap. The broken off device has a portion dimensioned and shaped so that the device can pierce the sealed outlet of the tube and also can close the outlet bore to keep material remaining in the tube in a usable condition.

DESCRIPTION OF THE PREFERRED EMBODIMENTS

Figure 1:
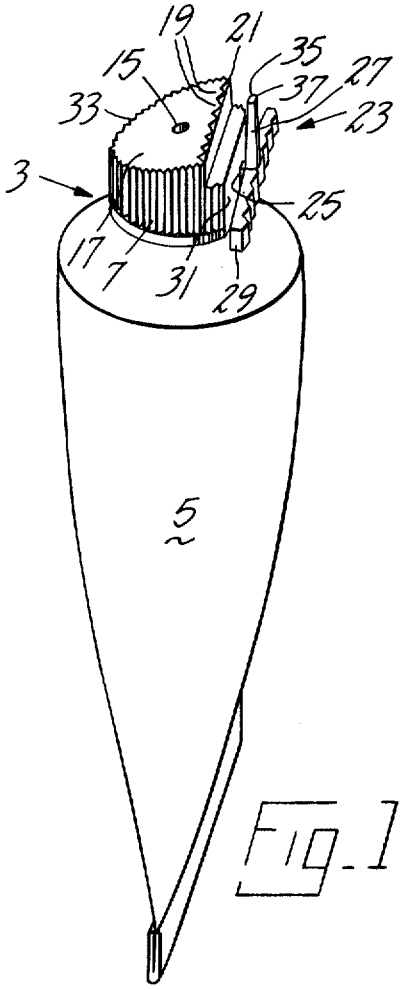
FIG. 1 is a perspective view of a compressible tube with an illustrative nozzle cap attached.
Figure 2:
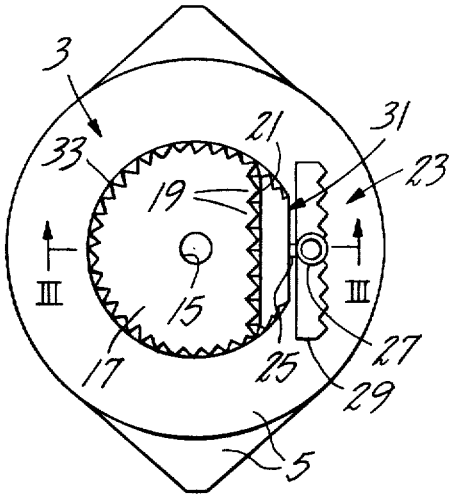
FIG. 2 is a plan view of the tube and cap drawn to a larger scale than FIG. 1.

The illustrative nozzle cap 3 shown in the drawings is for a compressible metal tube 5 and is injection molded from a suitable plastic material. The cap 3 comprises a generally cylindrical body 7 having an axially extending bore portion 9 (FIG. 3) screw-threaded for screwing on to a screw-threaded neck 11 of tube 5. Neck 11 provides an outlet for the contents of tube 5 which is sealed by an integral metal web closure 13.

An outlet bore 15 in cap 3 for the contents of tube 5 extends through body 7 from bore portion 9 in axial alignment therewith. Bore 15 opens through a sloping outer end surface 17 of the cap. Surface 17 is inclined to the axis of the bore at an angle convenient to use cap 3 as an applicator for extruded adhesive composition. Teeth 19 formed in a straight edge portion 21 of surface 17 may be used to faciitate spreading of the adhesive composition.

Formed integrally with cap 3 at a location distinct from outlet bore 15 is a device, generally referred to by the reference number 23. Device 23 is joined to body 7 by a frangible rib 25 of the plastic material. Device 23 comprises a tapering portion 27 extending parallel with bore 15, upwardly as viewed in FIGS. 1 and 3, and having an upper end for piercing. Dimensioned and shaped portion 27 extends from handle portion 29 of the device with the handle portion extending at right angles to the dimensioned and shaped portion 27. Frangible rib 25 extends from handle portion 29 to a flat face 31 formed in an outer peripheral surface 33 of cap 3. Surface 33 is otherwise generally concentric with the outlet bore 15 and ribbed to assist gripping of the cap for screwing on tube 5.

Straight edge portion 21 of end surface 17 extends parallel with face 31 and is formed by a "cut-away" portion between face 31 and outlet bore 15.

Figure 3:
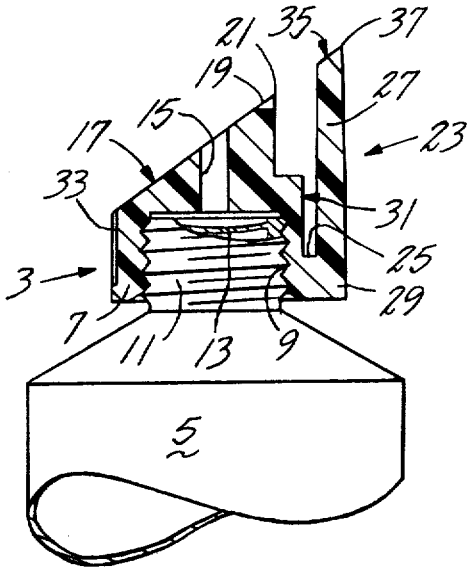
FIG. 3 is a sectional view of the cap taken on the line III—III in FIG. 2.

A chamber 35 is formed at the end of portion 27 which has a smallest diameter, the upper end viewed in FIGS. 1 and 3, to provide a piercing edge 37. Tube 5 is purchased with its adhesive contents sealed by closure 13 and nozzle cap 3 secured on neck 11 of the tube. At the time of using the tube's contents, device 23 may be grasped manually and broken from the cap. (Rib 25 provides a relatively weak connection and is readily broken.) Device 23 may then be inserted, edge 37 first, into outlet bore 15 with handle portion 29 of the device 23 gripped to force edge 37 through metal web closure 13. A ribbed outer face 39 of handle portion 29 aids gripping of device 23.

The contents of tube 5 are squeezed out through pierced closure 13 outlet bore 15 in nozzle cap 3 after removal of device 23.

After using some of the contents of tube 5, device 23 can be re-inserted into bore 15 since portion 27 of device 23 is dimensioned and shaped to become wedged in bore 15 and close it. The tapering of portion 27 allows device 23 to be firmly wedged in bore 15 to avoid inadvertent falling out and yet permits ready removal of the device for extrusion of remaining contents of the tube.

We claim:

1. A plastic nozzle cap for a compressible tube having a sealed outlet opening, said cap comprising an outlet bore, means for securing the cap to the tube, said outlet bore being positioned in a predetermined relationship with the outlet opening of the tube to which it is to be secured so that when the cap is secured to the tube, a device can be inserted into the outlet bore to pierce the sealed outlet opening of the tube said device being joined with a peripheral surface of the cap by means of an integrally molded frangible rib so that it can be readily broken from the cap and having a portion dimensioned and shaped so that the device can be inserted into the outlet bore for piercing the sealed outlet opening of the tube and for closing the outlet bore.

2. A plastic nozzle cap of claim 1 where the frangible rib is joined to a handle end portion of the device and the dimensioned and shaped portion extends from the handle portion.

3. A plastic nozzle cap in accordance with claim 2 wherein the dimensioned and shaped portion tapers from the handle end to provide an outer end of smallest diameter and a piercing edge is formed at said outer end.

4. A plastic nozzle cap of claim 3 where the device is integrally formed with the cap so that the dimensioned and shaped portion extends parallel with the outlet bore in the cap and its piercing end lies adjacent an outer end of the cap.

* * * * *